US005475940A

United States Patent [19]

Mauch et al.

[11] Patent Number: 5,475,940

[45] Date of Patent: Dec. 19, 1995

[54] FIREARM WITH GAS-ESCAPE PORT

[75] Inventors: Ernst Mauch, Dunningen; Manfred Gühring, Oberndorf-Beffendorf, both of Germany

[73] Assignee: Heckler & Koch, Oberndorf/Neckar, Germany

[21] Appl. No.: 211,363

[22] PCT Filed: Aug. 12, 1993

[86] PCT No.: PCT/EP93/02152

§ 371 Date: Mar. 30, 1994

§ 102(e) Date: Mar. 30, 1994

[87] PCT Pub. No.: WO94/04881

PCT Pub. Date: Mar. 3, 1994

[30] Foreign Application Priority Data

Aug. 24, 1992 [DE] Germany ..... 42 28 072.9

[51] Int. Cl.[6] ..... F41A 21/28; F41A 13/12

[52] U.S. Cl. ..... 42/75.02; 89/1.2; 89/14.1; 89/16

[58] Field of Search ..... 42/75.01, 75.02, 42/76.01; 89/1.2, 14.05, 14.1, 16

[56] References Cited

U.S. PATENT DOCUMENTS 2,816,484 12/1957 Grages ..... 89/14.1

FOREIGN PATENT DOCUMENTS

| | | |
|---|---|---|
| 516339 | 1/1953 | Belgium . |
| 148984 | 7/1985 | European Pat. Off. . |
| 807519 | 1/1937 | France . |
| 1210602 | 3/1960 | France . |
| 576518 | 5/1933 | Germany . |
| 3131265 | 5/1983 | Germany . |

*Primary Examiner*—Stephen C. Bentley
*Attorney, Agent, or Firm*—Cohen, Pontani, Lieberman, Pavane; Christa Hildebrand

[57] ABSTRACT

A firearm. The rear end of the barrel is directly adjacent to the frontmost point traveled by a slide. The slide travels back and forth inside the weapon's housing. The outside of the barrel is fastened directly or by way of an intermediary to a housing. The area inside the housing (12) and immediately behind the rear end (22) of the barrel (16) communicates with the atmosphere through at least one gas-escape port (26 or 26' & 20).

2 Claims, 1 Drawing Sheet

FIREARM WITH GAS-ESCAPE PORT

BACKGROUND OF THE INVENTION

1. Field of the Invention

The invention relates to a firearm. The weapon can be heavy, medium-weight, or light-weight, and automatic, semi-automatic, or single-loading. It will, however, preferably employ a magazine and have a locked or delayed slide. The barrel is preferably provided with a chamber accommodating a cartridge that comprises case, bullet, charge, and primer. The barrel can, however, also be employed for ammunition without a cartridge. The rear end of the barrel is directly adjacent to the frontmost point traveled by the slide. The slide travels back and forth inside the weapon's housing. The outside of the barrel is fastened directly or by way of an intermediary to the housing. The intermediary can be in one or more parts, concentric cylinders for example, and have a central perforation, whereby the rear of the barrel is secured in the perforation and whereby the rear end of the barrel is directly adjacent to the frontmost point traveled by a slide which travels back and forth inside the weapon's housing and the outside of the barrel is fastened directly or by way of an intermediary to a housing.

All terminology relating herein to direction relates to the direction traveled by the bullet with the weapon horizontal.

2. Discussion of the Prior Art

All known firearms occasionally malfunction due to gas unpredictedly escaping into the housing from the barrel. An obstruction in the bore for example can increase the pressure of the gas and split the cartridge case or primer compartment. A defective and too wide primer channel can force gas directly into the housing or prematurely retract the slide, allowing gas in. Again, a foreign body, the nose of the next cartridge for example, can set off the cartridge already in the chamber when the slide closes too slowly. A cartridge can enter and jam the chamber as a result of malfunction when a hot weapon is shot, and can ignite due to the heat. Finally, the powder may not bum all at once but generate a succession of rapid pressure peaks that open the slide before burnout has progressed sufficiently.

Common to all these admittedly rare occurrences is the escape of highly compressed gas into the area inside the housing and immediately behind the rear end of the barrel. The gas primarily acts on the walls of the housing at that point, although also on the slide and other components. The housing will buckle out as a result. The slide, any mechanisms intended to absorb the shock or accommodate the impact of the backward-traveling slide, and other components as well can be damaged. Finally, the shooter himself can be injured.

Such occurrences can to some extent be prevented by increasing the strength of the involved components, the housing for example. The result, however, is a heavier and more expensive weapon.

The object of the present invention is to improve a firearm of the aforesaid genus.

SUMMARY OF THE INVENTION

This object is attained in the generic firearm in accordance with the present invention in that the area inside the housing and immediately behind the rear end of the barrel communicates with the atmosphere by way of at least one gas-escape port that extends forward out of that area. Dangerously high pressure inside the housing due to malfunction will accordingly be relieved or prevented by escape of the gas. A weapon in accordance with the present invention will accordingly not need to be too heavy or expensive in order to be safe. Any damage resulting from the malfunctions hereintofore described will be too slight to prevent the weapon from continuing to operate.

A firearm with an auxiliary gas-escape port extending forward from the rear of the barrel is admittedly known from European Patent 0 148 984 B1 (Heckler & Koch). One end of the port communicates with the atmosphere through a sound absorber. The purpose of the port, however, is to decelerate the bullet's exit speed to the subsonic range. The port's other end extends through the wall of the barrel, allowing some of the gas that forms when a highspeed cartridge is fired to escape. German Patents 3 131 265 C1 (Heckler & Koch) and 576 518 (Rheinische) also describe auxiliary gas-escape ports, although they are located elsewhere and intended for other purposes.

It would of course alternatively be possible for the gas-escape ports to be simple radial perforations through the wall of the housing behind the barrel. Ports of this type, however, tend to allow water and dirt in, which can lead to malfunction. The ports in accordance with the present invention are accordingly not radial, but extend essentially forward, paralleling the barrel. They can accordingly terminate where they will not be exposed to contamination. The openings into the ports can also be closer to the chamber than openings into radial ports. Finally, radial ports would weaken the wall of the housing.

Another advantage of the present invention that derives from the ports extending forward to communicate with the atmosphere is that the barrel will cool more rapidly. This feature increases the threshold of self ignition or "cook-off." Cook-off also occurs later. In other words the weapon can be fired safely longer. The cooling effect of the gas ports in accordance with the present invention is augmented by the pumping action of the slide. The slide pumps cool air past the end of the barrel, that is, whenever a shot is fired. Finally, the walls of the ports act like cooling vanes.

The gas-escape ports in preferred embodiments of the invention extend through the intermediary or through the transition between the barrel and the housing wall or the intermediary and constitute longitudinal slots in the outer surface of the barrel or longitudinal channels in the inner surface of the housing or intermediary in that the gas-escape ports are longitudinal channels in the outer surface of the rear end of the barrel, or in that the gas-escape ports are longitudinal slots in the wall of the housing or intermediary and preferably behind the rear end of the barrel.

The particular advantage of this embodiment is that the ends of the ports extend to the front of the weapon from as near the rear of the chamber, where the pressure is particularly high, as possible. They accordingly expel the gas before it arrives at the wall of the housing. The front ends of the ports on the other hand terminate in an area exposed to much less contamination than the outer surface of the housing.

To decrease the risk of contamination and hence of injury to the shooter even further, another embodiment of the present invention incorporates a gas-decompression compartment that the front ends of the longitudinal gas-escape ports open into. The decompression compartment itself communicates with the atmosphere by way of at least one pressure-compensation aperture. The extracted gases are decompressed in the decompression compartment. It also intercepts contaminants and keeps them out of the longitudinal ports.

Another embodiment of the firearm is a light-weight weapon with a handguard surrounding the barrel, demarcating the gas-decompression compartment, and having weapon-cooling apertures extending through its wall. The weapon-cooling apertures also act as pressure-compensation apertures.

This embodiment requires no extra components in the weapon itself. The decompression compartment can be cleaned without additional efforts when the handguard is removed for its necessary cleaning.

Other embodiments of the invention have at least one additional safety valve extending radially out from the area inside the housing and immediately behind the rear end of the barrel into an enclosed space. The safety valves relieve the pressure of the gas when it is not compensated rapidly enough through the barrel-parallel gas-escape ports. The enclosed space they open into helps keep contaminants out and simultaneously orients the escaping gas away from the shooter and his comrades. The safety valves are preferably capped with caps that break or come off when the pressure attains a certain level. The safety valves also preferably full of plastic to keep contaminants out. The safety valves preferably slant radially downward.

BRIEF DESCRIPTION OF THE DRAWINGS

Embodiments of the invention will now be specified with reference to the attached schematic drawing, wherein.

DESCRIPTION OF THE PREFERRED EMBODIMENT

Figure 1:
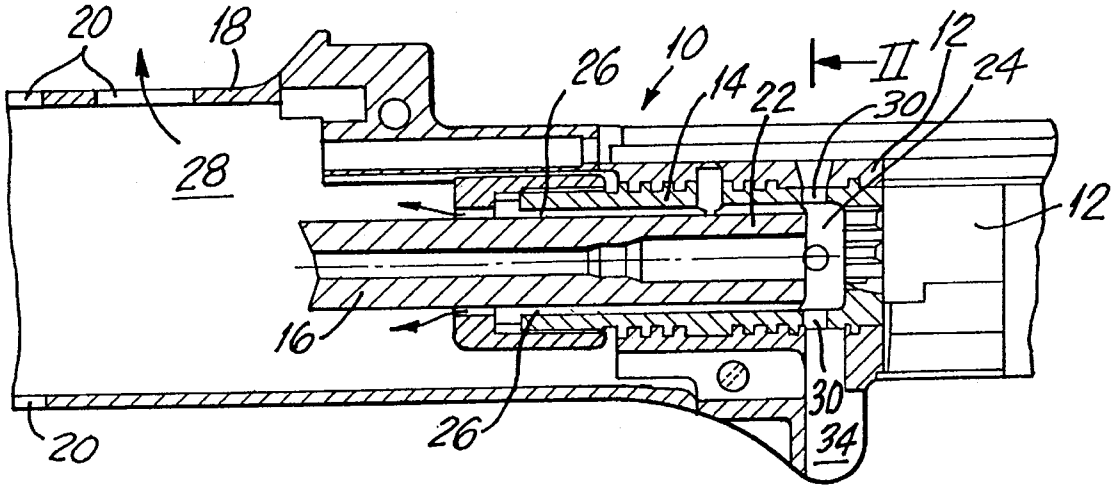
FIG. 1 is a broken longitudinal section through the middle of one embodiment of the invention constituted by a rapid-tire weapon with gas-escape ports in the form of longitudinal slots.

Similar components are labeled with the same number throughout the drawing and are specified only once.

An incompletely illustrated rapid-fire weapon 10 includes an essentially tubular and elongated housing 12 of thin sheet metal. Housing 12 accommodates a track for an unillustrated locked or delayed slide.

At the front of housing 12, which is on the left in the drawing, is an intermediary 14 in the form of two concentric cylinders with a central perforation aligned with the slide track. Secured in the front end of the perforation is a barrel 16.

Housing 12 extends forward in the form of a handguard 18 that surrounds barrel 16, leaving a considerable gap between. Handguard 18 is also cylindrical and is sheet metal, plastic, or wood. The front of handguard 18 encloses barrel 16. There are a number of weapon-cooling and pressure-compensation apertures 20 through the top, bottom, and front of the handguard.

Inside housing 12 and immediately behind the rear end 22 of barrel 16 is an excess-gas accommodation compartment 24. Compartment 24 constitutes the front of the slide track and is demarcated laterally by the walls of housing 12. Gas enters the compartment when for example barrel 16 is obstructed and its interior pressure increases and forces the cartridge and accordingly the slide backward before the pressure can decrease to an acceptable level. In this event the case cartridge case will burst or crack as it leaves the chamber and the gas will escape into compartment 24.

Excess pressure can derive from a defective, overcharged, cartridge, a cartridge that ignites prematurely due to the heat of the chamber, a slide that closes automatically due to the presence of a foreign body, a detonator cracker, etc.

The embodiment currently being specified herein is conventional to the extent hereintofore discussed.

It differs, however, from known weapons in that excess-gas accommodation compartment 24 communicates with a decompression compartment 28 inside handguard 18 through several gas-escape ports. It is accordingly impossible for enough pressure to become established to damage weapon 10.

Figure 3:
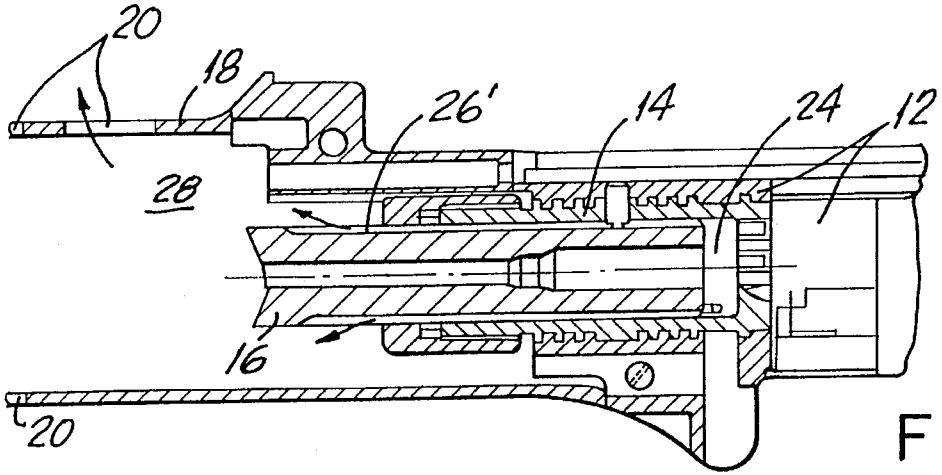
FIG. 3 is a broken longitudinal section through the middle of another embodiment constituted by a rapid-firing weapon similar to the embodiment illustrated in FIG. 1 but somewhat smaller.

The gas-escape ports can be either longitudinal slots 26 in the longitudinal perforation through intermediary 14 as in the embodiment illustrated in FIG. 1 or longitudinal channels 26' in the outer surface of the rear end 22 of barrel 16, secured in intermediary 14, as in the embodiment illustrated in FIG. 3. It is also possible for one weapon to incorporate both longitudinal slots 26 and longitudinal channels 26'.

What is essential is that the number, width, length, and shape of gas-escape ports 26 and/or 26' ensure that, when pressure builds up in excess-gas accommodation compartment 24, enough gas can escape into the decompression compartment (28) inside handguard 18 through the ports to maintain the pressure in the compartment below the critical level.

The cross-section of the weapon-cooling and pressure-compensation apertures 20 in handguard 18 also accords with the volume of gas escaping such that the excess pressure accumulating in the decompression compartment 28 inside handguard 18 will not damage handguard 18, and the gas escaping through apertures 20 will not injure the shooter.

Figure 2:
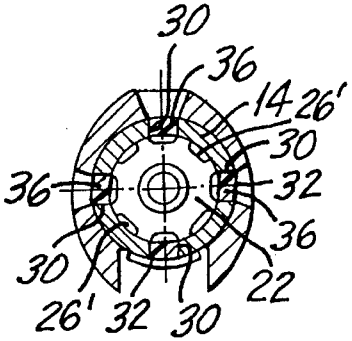
FIG. 2 is a cross-section along the line II—II in FIG. 1 through another version of the same embodiment illustrated in that Figure, with gas-escape ports in the form of longitudinal channels.

Auxiliary safety valves 30 extend radially out of the area inside housing 12 and immediately behind the rear end 22 of barrel 16, specifically into an enclosed space 34, in the embodiment illustrated in FIGS. 1 and 2. Safety valves 30 engage when the pressure of the excess gas cannot be compensated rapidly enough through longitudinal slots 26. Enclosed space 34 keeps contaminants out of housing 12 and orients any pressure fronts to keep the escaping gas away from the shooter or his comrades.

Further protection is provided by plastic caps 32 and plastic plugs 36. Plugs 36 obstruct safety valves 30. Caps 32 cap the valves and break when a certain threshold of pressure has been attained. Basically and preferably only one safety valve 30 is necessary, specifically extending radially straight down.

What is claimed is:

1. A firearm comprising a housing and a barrel having a front and a rear portion, the barrel is disposed in the housing, the rear portion of the barrel is adjacent to an excess gas compartment and the barrel is formed to provide at least one gas-escape means alongside the outside of the barrel parallel to the axis of the barrel to allow excess gas to escape from the excess gas compartment, further comprising at least one auxiliary safety opening extending radially out into an enclosed space from the area inside the housing and immediately behind the rear end of the barrel; and further comprising at least one plastic plug in the at least one safety opening.

2. The firearm of claim 1, further comprising plastic caps over the at least one safety opening that break when the pressure increases beyond a prescribed threshold.

* * * * *